United States Patent [19]

Wade

[11] 4,110,134

[45] Aug. 29, 1978

[54] WATER-IN-OIL EMULSION EXPLOSIVE COMPOSITION

[75] Inventor: Charles G. Wade, Lehighton, Pa.

[73] Assignee: Atlas Powder Company, Tamaqua, Pa.

[21] Appl. No.: 848,333

[22] Filed: Nov. 3, 1977

Related U.S. Application Data

[63] Continuation-in-part of Ser. No. 740,094, Nov. 9, 1976, abandoned.

[51] Int. Cl.[2] ..... G06B 45/00

[52] U.S. Cl. ..... 149/2; 149/41; 149/43; 149/44; 149/60; 149/61; 149/76; 149/82; 149/83; 149/85

[58] Field of Search ..... 149/2, 41, 44, 43, 60, 149/85, 82, 61, 83, 76

[56] References Cited

U.S. PATENT DOCUMENTS 4,008,108 2/1977 Chrisp ..... 149/2

*Primary Examiner*—Stephen J. Lechert, Jr.

*Attorney, Agent, or Firm*—Richards, Harris & Medlock

[57] ABSTRACT

Water-in-oil explosive compositions are provided which are No. 6 cap sensitive in cartridges having diameters of 1.25 inches and less and which contain from about 3.5 to about 8% by weight of a hydrocarbon fuel including an emulsifier, from about 10 to about 22% by weight of water, from about 0.25 to about 15% by weight of closed cell void containing materials, from about 65 to about 85% by weight of inorganic oxidizer salt, optionally, up to about 15% by weight of an auxiliary fuel and no explosive ingredients nor detonation catalysts.

41 Claims, No Drawings

WATER-IN-OIL EMULSION EXPLOSIVE COMPOSITION

BACKGROUND OF THE INVENTION

This application is a continuation-in-part of Ser. No. 740,094, filed Nov. 9, 1976, now abandoned.

This invention relates to water-in-oil emulsion explosive compositions. In a specific aspect, this invention relates to improved water-in-oil emulsion explosive compositions which are detonable by a No. 6 blasting cap, and are made of nonexplosive components.

Water-in-oil emulsion type blasting agents were first disclosed by Bluhm in U.S. Pat. No. 3,447,978. These emulsion type blasting agents contain an aqueous solution of inorganic oxidizer salt that is emulsified as the dispersed phase within a continuous carbonaceous fuel phase, and a uniformly distributed gaseous component. Such emulsion type blasting agents have many advantages over water slurry type blasting agents, but they are not cap sensitive. Therefore, such materials require a booster in order to effect their detonation.

Cattermole, et al., in U.S. Pat. No. Re28,060 teaches the addition of certain amine nitrate compounds to the water-in-oil emulsion compositions in order to assure that once detonated, the explosion will propagate in a 2 or 3 inch borehole. However, the mere addition of amine nitrates to the conventional water-in-oil emulsion type blasting agents will not render such materials cap sensitive. U.S. Pat. No. 3,770,522 suggests that the addition of materials such as trinitrotoluene, pentaerythritol tetranitrate, and the like to conventional water-in-oil blasting agents will render them cap sensitive. However, it is well known that such materials are explosives and are more expensive than conventional ingredients that go into the water-in-oil emulsion blasting agents, and the resulting products do not adequately perform in small diameter boreholes and are undesirable from other standpoints.

U.S. Pat. No. 3,715,247 and 3,765,964 disclose that water-in-oil emulsion explosive compositions can be prepared which retain all the advantages of the emulsion blasting agents described above, but are cap sensitive without the use of an explosive ingredient. These latter two patents disclose the addition of a detonation sensitizer or catalyst, such as an inorganic metal compound of Atomic No. 13 or greater, and strontium compounds.

Therefore, heretofore water-in-oil emulsion type blasting agents have been rendered cap sensitive by the addition of an explosive ingredient, or a specific detonation catalyst.

SUMMARY OF THE INVENTION

According to the invention, improved water-in-oil explosive compositions are provided that can be detonated with a No. 6 cap at diameters of 1.25 inches and less and that do not contain an explosive ingredient nor a detonation catalyst. The improved cap sensitive water-in-oil emulsion of the subject invention consists essentially of from about 3.5 to about 8% by weight of a hydrocarbon fuel including an emulsifier; from about 10 to about 22% by weight of water; from about 0.25 to about 15% by weight of closed cell void-containing materials sufficient to impart a density of from about 0.90 to about 1.35 g/cc to said explosive composition; from about 65 to about 85% by weight of inorganic oxidizer salt; and optionally, up to about 15% by weight of an auxiliary fuel such as aluminum. The inorganic oxidizer salt comprises principally ammonium nitrate and can contain another inorganic nitrate and/or an inorganic perchlorate.

DETAILED DESCRIPTION OF THE INVENTION

Thus, I have discovered that water-in-oil emulsion explosive compositions can be made and detonated with a No. 6 cap at diameters of 1.25 inches and less by the utilization of hydrocarbon fuels, water, oxidizer salts, closed cell void-containing materials, and optionally, aluminum or the like in the percentages set forth above and in the absence of explosive compositions or detonation catalysts. It is necessary that the proportions of the constituents be held in the ranges set forth above and that closed cell void-containing materials be utilized.

The water-in-oil explosive emulsions of the subject invention should preferably contain as the continuous phase thereof from about 3.5 to about 8% by weight of a carbonaceous fuel component including an emulsifier. The carbonaceous fuel component utilizable within the scope of this invention can include most hydrocarbons, for example, paraffinic, olefinic, naphthenic, aromatic, saturated or unsaturated hydrocarbons. In general, the carbonaceous fuel is a water immiscible emulsifiable fuel that is either liquid or liquefiable at a temperature up to about 200° F, and preferably between about 110° and about 160° F. At least 2.5% by weight of the total composition should be either a wax or oil, or mixture thereof. It is preferable that the carbonaceous fuel include a combination of a wax and an oil. Preferably, the wax content will range from about 2.5 to about 4.5% by weight and the oil content will range from about 0.5 to about 5.5% by weight of the total emulsion.

Waxes having melting points of at least 80° F, such as petrolatum wax, microcrystalline wax, and paraffin wax, mineral waxes such as ozocerite and montan wax, animal waxes such as spermacetic wax, and insect waxes such as beeswax and Chinese wax can be used in accordance with the present invention. Preferred waxes include waxes identified by the trade designations INDRA 1153, INDRA 5055-G, INDRA 4350-E, INDRA 2126-E and INDRA 2119 sold by Industrial Raw Materials Corporation, and a similar wax sold by Mobil Oil Corporation under the trade designation MOBIL 150. Other suitable waxes are WITCO 110X and WITCO ML-445, which are marketed by Witco Chemical Co., Inc. The most preferred waxes are a blend of microcrystalline waxes and paraffin such as the wax sold under the trade designation INDRA 2119 identified above. In this regard, field testing has shown that more shelf stable emulsions can be obtained by using a blend of microcrystalline wax and paraffin rather than microcrystalline or paraffin wax alone.

Examples of suitable oils include the various petroleum oils, vegetable oils, and various grades of dinitrotoluene; a highly refined mineral oil sold by Atlantic Refining Company under the trade designation ATREOL; a white mineral oil sold by Witco Chemical Company, Inc. under the trade designation KAYDOL; and the like.

The carbonaceous fuel component will also include the emulsifier which is used within the scope of the invention. The emulsifier is a water-in-oil emulsifier such as those derivable from sorbitol by esterification with removal of one molecule of water such as sorbitan fatty acid esters, for example, sorbitan monolaurate, sorbitan monooleate, sorbitan monopalmitate, sorbitan monostearate, and sorbitan tristearate. Other useful materials comprise mono- and diglycerides of fat-forming fatty acids, as well as polyoxyethylene sorbitol esters, such as polyethylene sorbitol beeswax derivative materials and polyoxyethylene(4)lauryl ether, polyoxyethylene(2)ether, polyoxyethylene(2)stearyl ether, polyoxyalkylene oleate, polyoxyalkylene laurate, oleyl acid phosphate, substituted oxazolines and phosphate esters, mixtures thereof and the like. In general, the emulsifiers should be present in an amount ranging from about 0.5 to about 2.0% by weight of the total composition, and preferably from about 0.8 to about 1.2% by weight of the total composition.

While its presence is not necessary, the emulsions of the subject invention can also contain up to about 15% by weight of an auxiliary fuel, such as aluminum, aluminum alloys, magnesium, and the like. Particulate aluminum is the preferred such auxiliary fuel.

The discontinuous aqueous phase of the subject emulsion should contain inorganic oxidizer salts dissolved in from about 10 to about 22% water, by weight of the total emulsion.

The inorganic oxidizer salt generally comprises from about 65 to about 85% by weight of the emulsion. The inorganic oxidizer salt should consist principally of ammonium nitrate, although up to about 20% by weight of the total composition can comprise either another inorganic nitrate such as an alkali or alkaline earth metal nitrate, or an inorganic perchlorate such as ammonium perchlorate or an alkali or alkaline earth metal perchlorate, or a mixture thereof. Preferably, the inorganic oxidizer salt will include up to about 10% of another inorganic nitrate and up to about 10% of an inorganic perchlorate, by weight of the total composition. The ammonium nitrate should preferably comprise from about 50 to about 70% by weight of the total composition, and will more preferably comprise from about 57 to about 70% by weight of the total composition. Furthermore, relative minor amounts of other oxidizer salts can also be present in the emulsions of the subject invention. When another inorganic nitrate is present in the oxidizer, it is preferred that the nitrate be sodium nitrate, although potassium nitrate and calcium nitrate can also be used, for example. When a perchlorate is present, it is preferred that ammonium or sodium perchlorate be used even though potassium and calcium perchlorate can be used, for example.

In compositions of the subject invention wherein the oxidizer salt comprises ammonium nitrate and another inorganic nitrate with no perchlorate, it is preferred that at least about 2.5 and up to about 20% by weight of the total emulsion be the other said inorganic nitrate. In such case, it is most preferable that from about 5 to about 10% by weight of the total emulsion comprise the other inorganic nitrate. Also, in this case, it is preferred that the ratio of ammonium nitrate to the other inorganic nitrate be in the range of from about 5–7:1. Furthermore, when the oxidizer salt consists of ammonium nitrate and a perchlorate salt, it is preferred that perchlorate be present in an amount in the range of from about 3 to about 20% by weight of the total emulsion and more preferably from about 5 to about 10% by weight of the total emulsion. Again it is preferred that the ratio of ammonium nitrate to perchlorate be in the range of from about 5–7:1. In the most preferred emulsions of the subject invention, it is preferred that ammonium nitrate, another nitrate (preferably sodium nitrate), and a perchlorate be present in relative amounts of about 5–6:1:1 to about 6–7:1:0.5, respectively.

The closed cell void containing material which is used in the scope of the subject invention is herein meant to encompass any particulate material which comprises closed cell, hollow cavities. Each particle of the material can contain one or more closed cells, and the cells can contain a gas, such as air, or can be evacuated or partially evacuated. Sufficient closed cell void containing material should be utilized to yield a density in the resulting emulsion of from about 0.90 to about 1.35 g/cc. In general, for any emulsion explosive composition made according to the ranges described herein, the maximum density will vary from about 1.35 to about 1.00 g/cc as the water content varies from about 10 to about 22% by weight. Thus, if the fuel and inorganic oxidizer salt content are held constant, the maximum density will decrease from about 0.01 to about 0.04 g/cc for each 1% increase in the water content of the emulsion in the range from about 10 to about 22 weight percent thereof. The term "maximum density" as used herein refers to the maximum density at which any emulsion explosive composition formulated within the prescribed ranges can be detonated by a No. 6 cap at a cartridge diameter of 1.25 inches at 70°–80° F and from 18 to 24 hours after the composition is made. Furthermore, for any specified percentage of water within the prescribed range, the maximum density of the emulsion will also vary as a function of the fuel and inorganic oxidizer salt content. Although the emulsion explosives of the present invention will preferably comprise at least about 2.5 weight percent wax, substituting oil for wax in the carbonaceous fuel phase will decrease the maximum density of the emulsions from about 0.005 to about 0.015 g/cc for each weight percent of oil so substituted.

Substituting an inorganic nitrate other than ammonium nitrate for the inorganic perchlorate component of the subject emulsions will decrease their maximum density from about 0.008 to about 0.01 g/cc for each weight percent of inorganic nitrate so substituted. Substituting an inorganic perchlorate for the other inorganic nitrate will increase the maximum density from about 0.008 to about 0.01 g/cc for each weight percent of inorganic perchlorate substituted.

Substituting ammonium nitrate for either the other inorganic nitrate or the inorganic perchlorate component of the formulations will decrease its maximum density from about 0.002 to about 0.01 g/cc for each weight percent of ammonium nitrate so substituted. On the other hand, substituting ammonium nitrate for both the other inorganic nitrate and the inorganic perchlorate components will leave the maximum density of the resulting emulsion explosive substantially unchanged, although the explosive power and low temperature sensitivity of the emulsion will be diminished.

The maximum density for any formulation of the subject invention can be easily determined. In essence, all formulations of the subject invention can be detonated by a No. 6 cap in 1.25 inch diameters at densities of 0.9 grams per cubic centimeter and higher. The maximum density, however, will vary as generally described above. This maximum density can be determined by merely increasing the density of any formulation of the subject invention by varying the content of the closed cell void containing material until detonation fails to occur by a No. 6 cap in a cartridge diameter of 1.25 inches for samples with densities from 0.01 to about 0.02 grams per cubic centimeter apart. Following the guidelines set forth above, no more than 2 to 4 samples need be made for each matrix in order to determine the maximum density of that particular formulation.

The preferred compositions of the subject invention have densities in the range of from about 1.1 to about 1.3 g/cc. In general, the water-in-oil emulsions of the subject invention can contain from about 0.25 to about 15% by weight of the closed cell void containing material. The preferred closed cell void containing materials which can be utilized within the scope of the subject invention are discrete glass spheres having a particle size within the range of about 10 to about 175 microns. In general, the bulk density of such particles can be within the range of about 0.1 to about 0.4 g/cc. Some preferred glass microbubbles which can be utilized within the scope of the subject invention are the microbubbles sold by 3M Company and which have a particle size distribution in the range of from about 10 to about 160 microns and a nominal size in the range of about 60 to 70 microns, and densities in the range of from about 0.1 to about 0.4 g/cc. The most preferred of such microbubbles sold by 3M Company are distributed under the trade designation B15/250. Other preferred such glass microbubbles are sold under the trade designation of Eccospheres by Emerson & Cumming, Inc., and generally have a particle size range from about 44 to about 175 microns at a bulk density of about 0.15 to about 0.4 g/cc. Other suitable microbubbles include the inorganic microspheres sold under the trade designation of Q-CEL by Philadelphia Quartz Company. In general the water-in-oil emulsions of the subject invention can contain from about 0.9 to about 15% by weight of the glass microbubbles.

The closed cell void containing material can be made of inert or reducing materials. For example, phenol-formaldehyde microballons can be utilized within the scope of this invention. It is noted, however, that if the phenol-formaldehyde microballons are utilized, the microballons themselves are a fuel component for the explosive and their fuel value should be taken into consideration when designing a water-in-oil emulsion explosive composition. Another closed cell void containing material which can be used within the scope of the subject invention is the saran microspheres sold by Dow Chemical Company. The saran microspheres have a diameter of about 30 microns and a particle density of about 0.032 g/cc. Because of the low bulk density of the saran microspheres, it is preferred that only from about 0.25 to about 1% by weight thereof be used in the water-in-oil emulsions of the subject invention.

In general, I have found that merely imparting the same density to compositions which would otherwise fall within the scope of the subject invention by entrained air bubbles or by porous glass agglomerates and the like, rather than the closed cell void containing material, will not yield No. 6 cap sensitive explosives that will detonate in 1.25 inches and smaller diameter cartridges. Thus, it was quite unexpected that the use of the glass microbubbles described above in the water-in-oil emulsion formulations of the subject invention would contribute to form a cap sensitive explosive, especially in view of the fact that glass microbubbles and other closed cell void containing materials have been utilized in conventional water gel explosives and they do not produce the same effect in such water gels as they do in my emulsion formulations.

The general criteria for cap sensitivity is that the explosive be sensitive to a No. 6 blasting cap at a cartridge diameter of 1.25 inch under normal temperature conditions. The cap sensitive explosive emulsions of the subject invention are shelf stable, which means they exhibit shelf stability of at least 6 months and typically 1 year or more. The explosives of the subject invention should not desensitize during normal operation, e.g., due to adverse weather conditions or should not be readily subject to dead pressing. Dead pressing occurs when the stock wave propagated from an explosion in one borehole compresses the explosive in an adjacent borehole so that its density is increased to such an extent that it is no longer detonable.

Furthermore, explosives of the subject invention are not so sensitive that they will cause hole-to-hole propagation. Hole-to-hole propagation occurs when one hole goes off and the percussion wave from that explosion sets off an explosive in an adjacent borehole. When this occurs, you get a simultaneous explosion in all boreholes. The simultaneous explosions resulting from hole-to-hole propagation can build up huge shock waves and intense vibrations that are detrimental to buildings, roads, bridges, or other structures often located adjacent to the blasting site.

Therefore, the cap sensitive explosive emulsions of the subject invention survive use in a variety of environments including mines which are cold and damp, wet and dry boreholes, trenching operations in developed areas, underwater usage such as ditching under rivers and lakes, and quarrying operations.

In general, the water-in-oil emulsion explosive compositions of the subject invention are sensitive at 20° F and lower and have excellent storage stability. Emulsions designed to be utilized under frigid conditions or stored more than six months should preferably contain the inorganic perchlorate as a component of the inorganic oxidizer salt portion of the emulsion.

The improved emulsions of the subject invention are preferably made by premixing the water and the inorganic oxidizer salts in a first premix, and the carbonaceous fuel and emulsifier in the second premix. The two premixes are heated, if necessary. The first premix is generally heated until the salts are completely dissolved (about 120° to 205° F), and the second premix is heated, if necessary, until the carbonaceous fuel has liquefied (generally about 120° F or more if wax materials are utilized). The premixes are then blended together and emulsified, and thereafter the glass microbubbles are added until the density is lowered to the required range. In the continuous manufacture of the emulsion compositions, it is preferred to prepare an aqueous solution containing the oxidizers in one tank and to prepare a mix of the organic fuel components (excluding the emulsifier) in another tank. The two liquid mixes and the emulsifier are then pumped separately into a mixing device wherein they are emulsified. The emulsion is next pumped to a blender where the glass microbubbles and auxiliary fuel, if desired, are added and uniformly blended to complete the water-in-oil emulsion. The resulting emulsion is then processed through a Bursa filler or other conventional device into packages of desired diameters. For example, the emulsion explosives can be packaged in spiral wound or convolutes polymer laminated paper cartridges.

The following examples are given to better facilitate the understanding of the subject invention but are not intended to limit the scope thereof.

EXAMPLE 1

The compositions set forth in Table 1 below were prepared by mixing a premix of water and the inorganic oxidizers at 160° F, and a second premix of the carbonaceous fuel and the emulsifier at 130° F. The first premix was then slowly added to the second premix with agitation to obtain a water-in-oil emulsion. Thereafter, the glass microbubbles and aluminum (when desired) were blended into the emulsion to form the final composition.

TABLE 1

| Ingredients | Compositions 1 | 2 | 3 | 4 |
|---|---|---|---|---|
| wax[1] | 3 | 2.85 | 3.0 | 2.85 |
| oil[2] | 1 | 0.95 | 1.0 | 0.95 |
| emulsifier[3] | 1 | 0.95 | 1.0 | 0.95 |
| water | 12 | 11.40 | 12.0 | 11.40 |
| ammonium nitrate | 61 | 57.95 | 67.6 | 64.22 |
| sodium nitrate | 10 | 9.5 | 3.0 | 2.85 |
| ammonium perchlorate | 10 | 9.5 | 0.0 | 0.0 |
| sodium perchlorate | 0 | 0.0 | 10.4 | 9.88 |
| glass microbubbles[4] | 2 | 1.90 | 2.0 | 1.90 |
| aluminum[5] | 0 | 5.00 | 0.0 | 5.00 |
| density (g/cc) | 1.15 | 1.17 | 1.15 | 1.17 |

[1]Paraffin wax sold under the trade designation INDRA 2119 by Industrial Raw Materials Corporation
[2]Kaydol Oil U.S.P. sold by Witco Chemical Co., Inc.
[3]Sorbitan monooleate sold by ICI-U.S. under the trademark SPAN 80
[4]Microbubbles sold by 3M Company under the trade designation B15/250
[5]Aluminum powder sold by Reynolds Aluminum Company under the trade designation HPS-10

All of the compositions set forth in Table 1 were extruded or tamped into paper tubes having a ½ inch diameter, sealed and then detonated with a conventional No. 6 electric blasting cap. Furthermore, emulsions having the same makeup as compositions 1–4 have been stored for periods of up to 2 years without loss of sensitivity.

EXAMPLE 2

The compositions set forth in Table 2 below were prepared by the same method which was utilized to prepare the compositions 1–4 in Table 1.

TABLE 2

| Ingredients | Compositions 5 | 6 | 7 | 8 |
|---|---|---|---|---|
| wax[1] | 2.71 | 2.660 | 3 | 2.85 |
| oil[2] | 0.90 | 0.885 | 1 | 0.95 |
| emulsifier[3] | 0.90 | 0.885 | 1 | 0.95 |
| water | 10.84 | 10.62 | 12 | 11.40 |
| ammonium nitrate | 55.09 | 59.60 | 66 | 62.70 |
| sodium nitrate | 9.03 | 8.85 | 10 | 9.50 |
| ammonium perchlorate | 9.03 | 5.00 | 5 | 4.75 |
| glass microbubbles[4] | 1.50 | 1.50 | 2 | 1.90 |
| aluminum[5] | 10.00 | 10.00 | 0 | 5.00 |
| density (g/cc) | 1.25 | 1.25 | 1.15 | 1.17 |

[1]a paraffin and microcrystalline wax blend sold by Witco Chemical Co. under the trademark Witco 110X.
[2]Kaydol Oil U.S.P. sold by Witco Chemical Co., Inc.
[3]Mono- and Diglycerides of fat forming fatty acids sold by ICU-U.S. under the trademark ATMOS 300
[4]Microbubbles sold by 3M Company under the trade designation B15/250
[5]Aluminum powder solder by Reynolds Aluminum Company under the trade designation HPS-10

Compositions 5 and 6 set forth in Table 2 were extruded or tamped into paper tubes having diameters of 1.25 inches; compositions 7 and 8 were extruded or tamped into paper tubes having a 1 inch diameter, and all were sealed and detonated with a conventional No. 6 electric blasting cap.

EXAMPLE 3

A series of emulsion explosive compositions was made by adding various amounts of B15/250 microbubbles described in Example 2, and water to an emulsion matrix formulation set forth in Table 3 below.

TABLE 3

| Ingredient | Weight % Used in Matrix[1] |
|---|---|
| wax[2] | 1.71 – 1.78 |
| wax[3] | 1.71 – 1.78 |
| oil[4] | 1.16 – 1.22 |
| emulsifier[5] | 1.15 – 1.22 |
| ammonium nitrate | 78.46 – 78.61 |
| sodium nitrate | 3.44 – 3.54 |
| sodium perchlorate | 12.06 – 12.13 |

[1]The actual weights of the ingredients used within the various test specimens varied no more than set forth in the ranges in Table 3.
[2]A microcrystalline wax sold under the trade designation of Witco X145A by Witco Chemical Company.
[3]A paraffin wax sold under the trade designation of Aristo 143° by Witco Chemical Company.
[4]A white mineral oil sold under the trade designation of Atreol 34 by Atlantic Refining Company.
[5]A sorbitan monooleate emulsifier sold under the trademark of Glycomul "O" by Glyco Chemicals Inc.

Samples were prepared using the above ingredients, but varying the water content from 10 to 22% by weight. The emulsions were packaged in 1.25 × 8 inch paper cartridges and tested with a No. 6 cap about 18 to 24 hours after being made. Maximum densities were then determined for each water content by varying the content of the above described microbubbles to vary the density until a detonation and failure occurred for samples with densities 0.01 to 0.02 g/cc apart. The results of those tests are tabulated in Table 4 below.

TABLE 4

| WEIGHT % WATER IN PRODUCT MATRIX | MAXIMUM DETONATION DENSITY (g/cc) |
|---|---|
| 10.0 | 1.32 |
| 12.2 | 1.30 |
| 14.0 | 1.28 |
| 16.0 | 1.26 |
| 18.0 | 1.20 |
| 20.0 | 1.14 |
| 22.0 | 1.07 |

EXAMPLE 4

A series of emulsion explosive compositions was prepared with differing wax:oil ratios in the carbonaceous fuel phase and ammonium nitrate:sodium nitrate:sodium perchlorate ratios in the discontinuous aqueous phase. Five different matrices containing the same amount of water were first made by mixing a premix of water and the inorganic oxidizers at 160° F, and a second premix of the carbonaceous fuel and emulsifier at 130° F. The first premix was then slowly added to the second premix with agitation to obtain a water-in-oil emulsion. Thereafter the maximum densities for each matrix were determined in the manner set forth in Example 3. The compositions and maximum densities of the five basic matrices are set forth in Table 5 below.

TABLE 5

| INGREDIENTS | MATRICES (Compositions Expressed in Wt. %) 1 | 2 | 3 | 4 | 5 |
|---|---|---|---|---|---|
| wax[1] | 1.5 | 1.5 | — | — | — |
| wax[2] | 1.5 | 1.5 | — | — | — |
| oil[3] | 1.0 | 1.0 | 4.0 | 4.1 | 4.0 |
| emulsifier[4] | 1.0 | 1.0 | 1.0 | 1.0 | 1.0 |
| ammonium nitrate | 67.6 | 67.6 | 67.6 | 65.9 | 81.0 |
| sodium nitrate | 3.0 | 13.4 | 3.0 | 15.0 | — |
| sodium perchlorate | 10.4 | — | 10.4 | — | — |
| water | 14.0 | 14.0 | 14.0 | 14.0 | 14.0 |

TABLE 5-continued

| INGREDIENTS | MATRICES (Compositions Expressed in Wt. %) 1 | 2 | 3 | 4 | 5 |
|---|---|---|---|---|---|
| maximum density (g/cc) | 1.28 | 1.18 | 1.25 | 1.21 | 1.25 |

[1]A microcrystalline wax sold under the trade designation of WITCO X145A by Witco Chemical Company.
[2]A paraffin wax sold under the trade designation of Aristo 143° by Witco Chemical Company.
[3]A white mineral oil sold under the trade designation of Atreol 34 by Atlantic Refining Company.
[4]A Sorbitan monooleate emulsifier sold under the trademark of Glycomul "O" by Glyco Chemicals Inc.

The above examples illustrate that extremely sensitive explosives which are made in the form of water-in-oil type emulsions can be made in accordance with the subject invention. The water-in-oil emulsions of the subject invention are sensitive to conventional No. 6 blasting caps and are suitable for detonation in small diameters of about 1.25 inches and less. Furthermore, the explosives are suitable as primers for other less sensitive explosives.

The subject water-in-oil emulsions are sensitized without the use of conventional high explosives and without the use of special initiation or detonation catalysts, but yet possess all the advantages of the conventional water-in-oil type emulsion blasting agents. They will not produce headaches; they possess water resistance as an intrinsic property of their physical form; they are safe from initiation by fire, rifle bullet, impact, friction or static electricity; they lend themselves to continuous processing and can be extruded during manufacture; and they are noncorrosive, that is, they are not severely acidic or basic.

While this invention has been described in relation to its preferred embodiments, it is to be understood that various modifications thereof will be apparent to those of ordinary skill in the art upon reading this specification and it is intended to cover all such modifications as fall within the scope of the appended claims.

What is claimed is:

1. A water-in-oil explosive composition that is detonable by a No. 6 cap in cartridge diameters of about 1.25 inches and less consisting of:
   (a) a continuous phase of a carbonaceous fuel;
   (b) a discontinuous aqueous phase containing an inorganic oxidizer composed principally of ammonium nitrate;
   (c) from about 0.5% to about 2% by weight of the composition of an emulsifier selected from the group consisting of sorbitan fatty esters, glycerides of fat-forming fatty acids, polyoxyethylene sorbitol esters, polyoxyethylene ethers, polyoxyalkylene oleate, polyoxyalkylene laurate, oleyl acid phosphate, substituted oxazolines and phosphate esters thereof;
   (d) up to about 15% by weight thereof of an auxiliary fuel; and
   (e) sufficient closed cell void containing material to yield a density of said explosive composition in the range of from about 0.90 g/cc to about 1.35 g/cc.

2. The explosive composition of claim 1 wherein from about 2.5 to about 20% by weight of said composition is an inorganic nitrate other than ammonium nitrate.

3. The explosive composition of claim 2 wherein from about 5 to about 10% by weight of said composition is an inorganic nitrate other than ammonium nitrate.

4. The explosive composition of claim 2 wherein said inorganic nitrate is selected from the group consisting of alkali metal and alkaline earth metal nitrates.

5. The explosive composition of claim 4 wherein said inorganic nitrate is sodium nitrate.

6. The explosive composition of claim 1 comprising from about 3 to about 20% by weight of an inorganic perchlorate.

7. The explosive composition of claim 6 comprising from about 5 to about 10% by weight of an inorganic perchlorate.

8. The explosive composition of claim 6 wherein said inorganic perchlorate is selected from the group consisting of ammonium, alkali metal and alkaline earth metal perchlorates.

9. The explosive composition of claim 1 wherein said carbonaceous fuel comprises water immiscible emulsifiable material selected from the group consisting of petrolatum, microcrystalline, paraffin, mineral, animal, and insect waxes, petroleum oils, and vegetable oils.

10. The explosive composition of claim 9 wherein up to about 5.5% by weight thereof is an oil.

11. The explosive composition of claim 9 wherein up to about 4.5% by weight thereof is a wax.

12. The explosive composition of claim 11 wherein the wax comprises a blend of microcrystalline wax and paraffin wax.

13. The explosive composition of claim 1 wherein said auxiliary fuel is particulate aluminum.

14. The explosive composition of claim 1 wherein said closed cell void containing material is present in an amount of from about 0.25 to about 15% by weight of said composition.

15. The explosive composition of claim 14 wherein said closed cell void containing material is glass microbubbles ranging from about 0.9 to about 15% by weight of the total composition.

16. The explosive composition of claim 14 wherein said closed cell void containing material is saran microspheres ranging from about 0.25 to about 1% by weight of the total composition.

17. The explosive composition of claim 1 wherein said discontinuous aqueous phase comprises from about 10 to about 22% water by weight of the total composition.

18. The explosive composition of claim 1 wherein said continuous phase of carbonaceous fuel including said emulsifier is from about 3.5 to about 8% by weight of said explosive composition.

19. The explosive composition of claim 1 wherein said inorganic oxidizer is present in an amount of from about 65 to 85% by weight of said emulsion.

20. A water-in-oil explosive composition that contains no explosive compounds nor detonation catalysts but that is detonable by a No. 6 cap in cartridge diameters of about 1.25 inches and less consisting essentially of:
   (a) a continuous phase of a carbonaceous fuel;
   (b) a discontinuous aqueous phase containing an inorganic oxidizer composed principally of ammonium nitrate;
   (c) from about 0.5 to about 2% by weight of the composition of a water-in-oil type emulsifier which forms said composition;
   (d) from 0 to about 15% by weight thereof of an auxiliary fuel; and (e) sufficient closed cell void containing material to yield a density of said explosive composition in the range of from about 0.9 g/cc to about 1.35 g/cc.

21. The water-in-oil explosive composition of claim 20 wherein said continuous phase of a carbonaceous fuel including said emulsifier is present in an amount of the range of from about 3.5 to about 8% by weight of said composition.

22. The water-in-oil explosive composition of claim 20 wherein the water in said discontinuous aqueous phase is present in an amount ranging from about 10 to about 22% by weight of said composition.

23. The water-in-oil explosive composition of claim 20 wherein said inorganic oxidizer is present in an amount ranging from about 65 to about 85% by weight of said composition.

24. The explosive composition of claim 20 wherein said carbonaceous fuel comprises a water immiscible material selected from the group consisting of petrolatum, microcrystalline, paraffin, mineral, animal and insect waxes, petroleum oils and vegetable oils.

25. The explosive composition of claim 24 wherein from about 0.5 to about 5.5% by weight thereof is an oil.

26. The explosive composition of claim 24 wherein from about 2.5 to about 4.5% by weight thereof is a wax.

27. The explosive composition of claim 24 wherein the wax comprises a blend of microcrystalline wax and paraffin wax.

28. The explosive composition of claim 20 wherein said auxiliary fuel is selected from the group consisting of aluminum, aluminum alloys, and magnesium.

29. The explosive composition of claim 28 wherein said auxiliary fuel is aluminum.

30. The explosive composition of claim 20 wherein said emulsifier is selected from the group consisting of sorbitan fatty esters, glycerides of fat-forming fatty acids, polyoxyethylene sorbitol esters, polyoxyethylene ethers, polyoxyalkylene oleate, polyoxyalkylene laurate, oleyl acid phosphate, substituted oxazolines and phosphate esters thereof.

31. The explosive composition of claim 20 wherein said inorganic oxidizer is ammonium nitrate and an inorganic nitrate selected from the group consisting of alkali metal and alkaline earth metal nitrates.

32. The explosive composition of claim 31 wherein the ratio of said ammonium nitrate to said inorganic nitrate is in the range of 5–7:1.

33. The explosive composition of claim 20 wherein said inorganic oxidizer is ammonium nitrate and an inorganic perchlorate selected from ammonium, alkali metal and alkaline earth metal perchlorates.

34. The explosive composition of claim 33 wherein the ratio of ammonium nitrate to inorganic perchlorate is in the range of from about 5–7:1.

35. The explosive composition of claim 20 wherein said inorganic oxidizer is ammonium nitrate and another inorganic nitrate selected from the group consisting of alkali metal and alkaline earth metal nitrates, and an inorganic perchlorate selected from ammonium, alkali and alkaline earth metal perchlorates.

36. The explosive composition of claim 35 wherein the ratio of ammonium nitrate, said inorganic nitrate and said inorganic perchlorate is in the range of from about 5–6:1:1 to about 6–7:1:0.5, respectively.

37. The explosive composition of claim 35 wherein said other inorganic nitrate is sodium nitrate.

38. The explosive composition of claim 35 wherein said inorganic perchlorate is ammonium perchlorate.

39. The explosive composition of claim 35 wherein said inorganic perchlorate is sodium perchlorate.

40. The explosive composition of claim 20 wherein said closed cell void containing material is glass microbubbles ranging from about 0.9 to about 15% by weight of the total composition.

41. The explosive composition of claim 20 wherein said closed cell void containing material is saran microspheres ranging from about 0.25 to about 1% by weight of the total composition.

* * * * *

UNITED STATES PATENT AND TRADEMARK OFFICE

CERTIFICATE OF CORRECTION

PATENT NO. : 4,110,134

DATED : August 29, 1978

INVENTOR(S) : Charles G. Wade

It is certified that error appears in the above-identified patent and that said Letters Patent are hereby corrected as shown below:

Column 12, line 12, change "from ammonium" to --from the group consisting of ammonium--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*